US010355368B2

(12) United States Patent
AlShareef et al.

(10) Patent No.: US 10,355,368 B2
(45) Date of Patent: Jul. 16, 2019

(54) ENERGY HARVESTING DEVICE COMPOSED OF ELECTRICALLY SMALL PARTICLES

(71) Applicant: King Abdulaziz City for Science and Technology, Riyadh (SA)

(72) Inventors: Mohammed R. AlShareef, Riyadh (SA); Omar M. Ramahi, Waterloo (CA)

(73) Assignee: KING ABDULAZIZ CITY FOR SCIENCE AND TECHNOLOGY, Riyadh (SA)

( * ) Notice: Subject to any disclaimer, the term of this patent is extended or adjusted under 35 U.S.C. 154(b) by 347 days.

(21) Appl. No.: 15/165,231

(22) Filed: May 26, 2016

(65) Prior Publication Data

US 2017/0346193 A1 Nov. 30, 2017

(51) Int. Cl.

*H01Q 13/20* (2006.01)
*H01Q 21/06* (2006.01)
*H01Q 1/24* (2006.01)

(52) U.S. Cl.

CPC ..... *H01Q 21/061* (2013.01); *H01Q 1/248* (2013.01)

(58) Field of Classification Search

CPC ..... H01Q 21/0075; H01Q 1/38
USPC ..... 343/731
See application file for complete search history.

(56) References Cited

U.S. PATENT DOCUMENTS 8,115,683 B1 2/2012 Stefanakos
8,874,180 B2 10/2014 McKenna et al.
9,103,920 B2 8/2015 Valentino et al.
9,929,336 B2 * 3/2018 Baik ..... H01L 41/113
2010/0032001 A1 2/2010 Brantner
2011/0180699 A1 * 7/2011 Cooley ..... H01J 49/107 250/282
2011/0248846 A1 10/2011 Belov et al.
2014/0266967 A1 9/2014 Ramahi et al.
2015/0303335 A1 * 10/2015 Kotter ..... G02B 5/281 250/208.2
2016/0006123 A1 * 1/2016 Li ..... H01Q 7/00 343/867
2016/0149441 A1 * 5/2016 Nayak ..... H02J 50/27 307/149

FOREIGN PATENT DOCUMENTS

EP 2499677 9/2012

OTHER PUBLICATIONS

Electromagnetic Energy Harvesting Using Complementary Split-Ring Resonators, Published online Apr. 24, 2014, pp. 163903-1, 163903-2, 163903-3, 163903-4; 2014 AIP Publishing, LLC; Inventors: Alavikia, Almoneef, and Ramahi Applied Physics Letter 104, 163903 (2014).*

(Continued)

*Primary Examiner* — Lam T Mai

(74) *Attorney, Agent, or Firm* — Andrew M. Calderon; Roberts Mlotkowski Safran Cole & Calderon, P.C.

(57) ABSTRACT

An energy harvesting device includes: a substrate; a plurality of split-ring resonators (SRRs) on the substrate configured to generate a voltage based on receiving incident light waves; and a transmission line electrically coupled to the plurality of SRRs, the transmission line being configured to transmit the generated voltage to an external system.

15 Claims, 14 Drawing Sheets

(56) References Cited

OTHER PUBLICATIONS

Gratzel, "Photovoltaic and . . . solar energy," Philosophical Transactions of the Royal Society A: Mathematical, Physical Engineering Sciences, vol. 365, (2007), 13 pages.
Alici et al., "Electrically small split ring resonator antennas," Journal of Applied Physics 101, (2007), 5 pages.
Bozzetti et al., "Analysis and . . . rectenna," in Industrial Electronics (ISIE), 2010 IEEE International Symposium on, (2010), 5 pages.
Urzhumov et al., "Metamaterial-enhanced coupling between magnetic dipoles for efficient wireless power transfer," Phys. Rev. B, vol. 83, (2011), 23 pages.
AlShareef et al., "Electrically small resonators for energy harvesting in the infrared regime," Journal of Applied Physics , vol. 114, (2013), 7 pages.
AlShareef et al., "Electrically small particles combining even- and odd-mode currents for microwave energy harvesting," Applied Physics Letters , vol. 104, (2014), 6 pages.
Qu et al., "Terahertz transmission properties of thin, subwavelength metallic holearrays," Opt. Lett., vol. 29, (2004), 3 pages.
Withayachumnankul et al., "Measurement of linearity in THz-TDS," in Infrared, Millimeter, and Terahertz Waves, 2009. IRMMW-THz 2009, (2009), 3 pages.
Slocum et al.,"Atmospheric absorption of terahertz . . . vapor continuum effects," Journal of Quantitative Spectroscopy and Radiative Transfer, vol. 127, (2013), 15 pages.
Zhu et al., "Toward Large-Scale Energy Harvesting by a . . . Triboelectric Nanogenerator", 2013 American Chemical Society, pp. 847-853, Jan. 29, 2013, 7 pages.
AlShareef et al., "Electrically small resonators for energy harvesting in the infrared regime", Journal of Applied Physics 114, 223101 (2013), 7 pages.
Kotter et al., "Theory and Manufacturing Processes of Solar Nanoantenna Electromagnetic Collectors," Journal of Solar Energy Engineering, vol. 132, Feb. 2010, 9 pages.
AlShareef et al., "Arrays of Electrically-Small Resonators for Electromagnetic Energy Harvesting in the Teraherz, Infrared and Visible Frequency Spectra", Department of Electrical and Computer Engineering, University of Waterloo, Waterloo, ON N2L 3G1, Canada, Dec. 5, 2013, 7 pages.

* cited by examiner

ENERGY HARVESTING DEVICE COMPOSED OF ELECTRICALLY SMALL PARTICLES

FIELD OF THE INVENTION

The invention relates to energy harvesting devices and, more particularly, to energy harvesting devices composed of electrically small particles.

BACKGROUND

Substantial research, development and other efforts have been devoted to the development of efficient and environmentally friendly energy harvesting devices. Photovoltaic technology is one of the most prominent sustainable energy technologies, and accordingly, substantial sustainable energy research advancements have been made in this technology area. However, energy harvesting devices based on photovoltaic technologies have typically had relatively low conversion efficiencies (e.g., approximately 50% conversion efficiency). Also, devices based on photovoltaic technologies are typically relatively expensive.

Photovoltaic technology also does not have the capability to take advantage of a substantial area of the solar spectrum, since photovoltaic technology is only able to harvest the visible sunlight. For example, the earth receives more than 100 petawatts (i.e., 100×1015 watts) of solar power that cover different spectrums ranging from infrared to visible waves. Solar power accounts for a substantial amount of the power that penetrates the atmosphere in forms of infrared energy. More specifically, solar power accounts for electromagnetic radiation of over one kilowatt per square meter that reaches sea level, approximately half of which is infrared radiation. Infrared spectrum that extends from approximately 1 millimeter (mm) to approximately 1 μm is located between the radio and visible regimes. At 10 micrometer (μm) wavelength, the atmospheric transmittancy reaches approximately 80%, which means a substantial amount of infrared radiation reaches to the earth at sea level. Photovoltaic technology also does not have the capability to take advantage of a substantial area of the solar spectrum, since photovoltaic technology is only able to harvest the visible sunlight.

Antenna-based energy harvesting techniques, on the other hand, leverage solar energy from non-visible radiation. In antenna-based energy harvesting techniques, attention has typically been focused on harnessing solar energy using classical antennas, by which electromagnetic waves can be confined and directed to an intended load. For solar energy harvesting, a nanoantenna is not only able to harness the visible light, but it can be properly scaled to collect infrared radiation as well. A square spiral antenna is an example of an antenna-based energy harvesting device. An example conventional square spiral antenna typically operates at a frequency of approximately 28.3 THz and has a total length of approximately 10.6 μm.

Typically, power harvesting using conventional collectors (e.g., classical antennas or radiators) do not provide a highly efficient energy harvesting, are complex to manufacture and design, and have destructive coupling issues.

SUMMARY

In an aspect of the invention, an energy harvesting device comprises: a substrate; a plurality of split-ring resonators (SRRs) on the substrate configured to generate a voltage based on receiving incident light waves; and a transmission line electrically coupled to the plurality of SRRs, the transmission line being configured to transmit the generated voltage to an external system.

In an aspect of the invention, an energy harvesting device comprises: a substrate; a plurality of split-ring resonators (SRRs) on the substrate, wherein the plurality of SRRs are configured to generate a voltage based on receiving incident light waves; a transmission line electromagnetically coupled to the plurality of SRRs, wherein the transmission line is configured to transmit the generated voltage to an external system; a via located at a distal end of the transmission line; and a ground plane electrically coupled to the transmission line through the via.

In an aspect of the invention, an energy harvesting device comprises: a substrate; a plurality of electrical resonators on the substrate, wherein the plurality of electrical resonators are configured to generate a voltage based on receiving incident light waves; and a waveguide electrically coupled to the plurality of electrical resonators, wherein the waveguide is configured to transmit the generated voltage to an external system.

BRIEF DESCRIPTION OF THE DRAWINGS

The present invention is described in the detailed description which follows, in reference to the noted plurality of drawings by way of non-limiting examples of exemplary embodiments of the present invention.

DETAILED DESCRIPTION

The invention relates to energy harvesting devices and, more particularly, to energy harvesting devices composed of electrically small particles. Aspects of the present invention may include an energy harvesting device which is composed of electrically small particles, such as split-ring resonators (SRRs). The electrically small particles are particles whose largest dimension is substantially small compared with the free space wavelength $\lambda o$. In alternative embodiments, other types of electrically small particles may be used (e.g., metamaterial resonators, electrically-small at dipoles, monopoles, or other structures that are fundamentally electrically small).

In embodiments, the energy harvesting device may include a transmission line connected to a ground plane to harvest and channel electromagnetic energy to a potential load. The SRRs capture incident electromagnetic waves (e.g. from the sun) and deliver the energy through a channeling route to a resistive load which can in turn, transfer the energy to an external system (e.g., a battery and/or electrically consuming device). The SRR shape is advantageous, since the SRR exhibits the negative constitutive parameters, either the permittivity $\epsilon$, or permeability, $\mu$, or both.

As described herein, the use of electronically small particles in an energy harvesting system provides several advantages. For example, metamaterial resonators minimize the environmental impact of the energy harvesting system. Further, the destructive coupling effect between two adjacent SRR cells is much weaker in comparison to antenna coupling, hence, the distance maintained between cells is much smaller than the $\lambda o/2$ required by classical antennas. Also, the power collected from the single negative media is much higher than that of electromagnetic radiators due to the high electric field confinement within a very small area (SRR's gap).

Aspects of the present invention may take advantage of electromagnetic coupling (a phenomenon in which voltage transfers from one medium to another without a physical connection). Typically, electromagnetic coupling is a negative phenomenon in which voltage transfers adversely impact a system. However, aspects of the present invention transform this typically negative phenomenon into a benefit by transferring voltage, generated by SRRs upon contact with infrared waves, to a desired location (e.g., a battery and/or other external systems that consume or store electrical energy).

Figure 1:
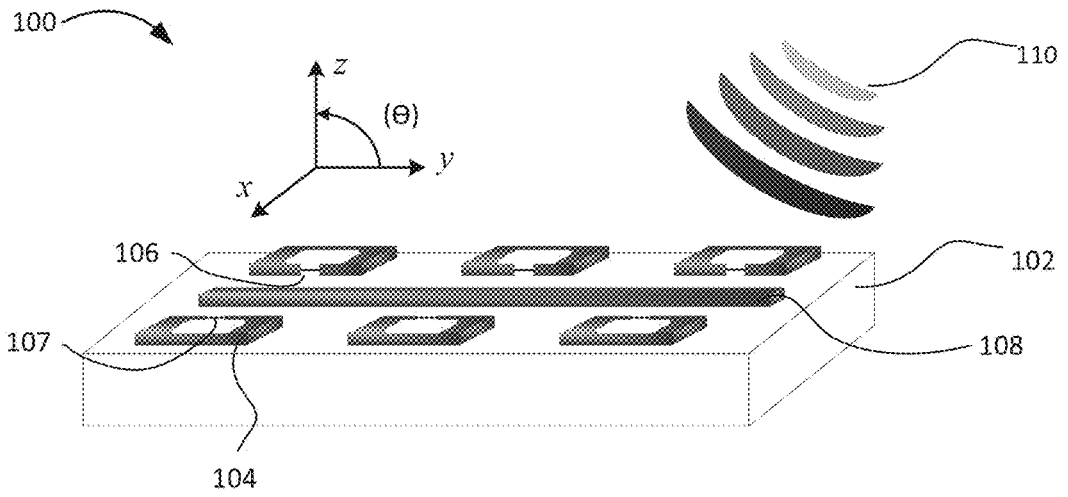
FIG. 1 shows a perspective view of an energy harvesting device in accordance with aspects of the present invention.

FIG. 1 shows a perspective view of an energy harvesting device in accordance with aspects of the present invention. As shown in FIG. 1, the energy harvesting device 100 includes a substrate 102, multiple SRRs 104, and a transmission line 108. The substrate 102 may include a dielectric material, such as oxide, for example. In embodiments the substrate 102 may include a substrate used for optic or microwaves applications, and may include plexiglass, on glass, and/or any non-conductive media. In embodiments, the distance between adjacent SRRs 104 can be optimized to maximize the collected power per cell.

Each SRR 104 and the transmission line 108 is provided on a top surface of the substrate 102. In embodiments, each SRR 104 may be made of electrically-conductive material that is suspended, printed and/or etched in a nonconductive host medium, such as the substrate 102. As described herein, the array of SRRs 104 may include other electrically-small devices at dipoles, monopoles, or other structures that are fundamentally electrically small such that the resonance mechanism in each structure is that of electrically-small structure resonance.

The energy harvesting device 100 of FIG. 1 shows a 1×3 array of SRRs 104, although other configurations may be implemented (e.g., a 3×3 array, a 4×4 array, etc.). Also, the SRRs 104 may be arranged symmetrically or non-symmetrically, as described in greater detail with respect to FIG. 4.

As described herein, energy is harvested by the energy harvesting device 100 from incident waves 110. The incident waves 110 may be infrared waves associated with the sun or other infrared energy source (e.g., from a simulated environment). As described herein, when incident waves 110 contact the SRRs 104, a voltage develops across the resistors 106. The voltage is transferred to the transmission line 108 via the phenomenon of electromagnetic coupling in which voltage transfers from one medium to another without a physical connection. As described herein, the energy absorbed (e.g., the voltage generated by the SRRs 104) may vary based on the angle $\theta$ of the incident wave 110. The transmission line 108 transfers the absorbed energy (e.g., the generated voltage) to a resistive load placed at a distal end of the transmission line. Further, energy can be transferred from the resistive load to a desired location or external system.

Figure 2:
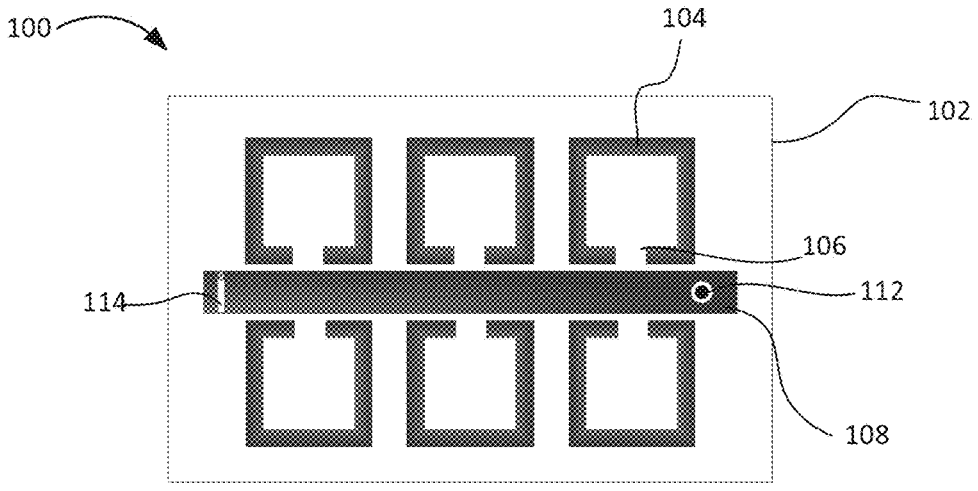
FIG. 2 shows a plane view of an energy harvesting device in accordance with aspects of the present invention.
Figure 3:
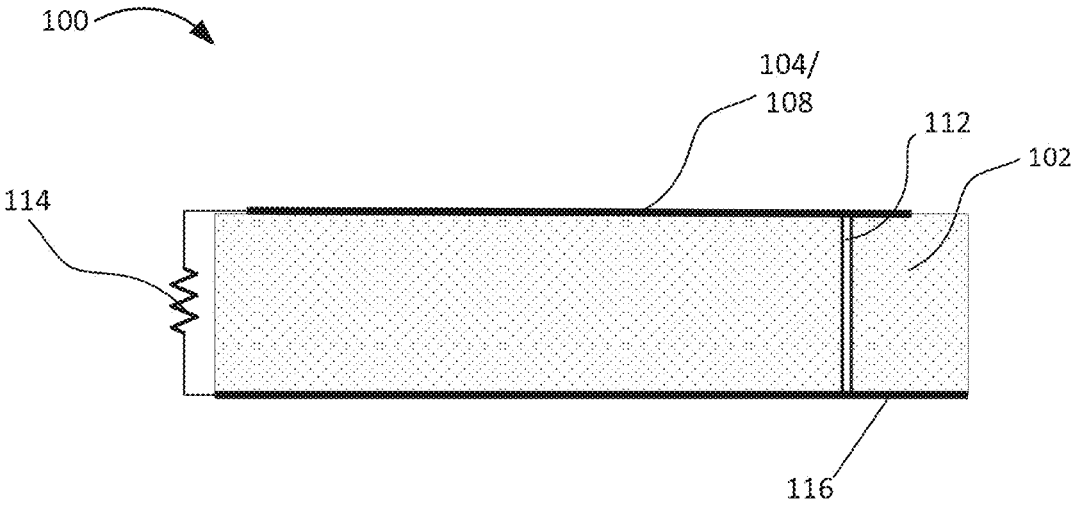
FIG. 3 shows a side view of an energy harvesting device in accordance with aspects of the present invention.

Referring to FIG. 2, the transmission line 108 may transfer the generated voltage to a resistive sheet 114, which may further improve the performance of the energy harvesting device 100. As further shown in FIG. 2, the energy harvesting device 100 may further include a via 112 through which a ground plane 116 is connected. For example, referring to FIG. 3, the via 112 connects the transmission line 108 to the ground plane 116. The resistive sheet 114 connects one terminal of the transmission line 108 to the ground plane 116. The value of the resistive sheet 114 may be selected to achieve maximum power transfer from the incident wave 110 to a resistive load. As an example, the value of the resistive sheet 114 may be 100Ω. For optimal matching between the load and transmission line 108, the characteristic impedance of the transmission line 108 may be equal to the load. Alternative collection and transmission techniques may be used with consideration to design decisions such as footprint size, energy losses, and power matching complexities. In embodiments, the transmission line 108 may be connected to a rectifier or diode to convert alternating current (AC) power to direct current (DC) power.

In embodiments, the energy harvesting device 100 may include a different number or arrangement of the components shown and described herein. For example, the energy harvesting device 100 may include multiple transmission lines 108 or different arranged transmission lines than is shown and described. Further the transmission line 108 may be placed substantially in the center of the substrate 102, may be placed next to the SRRs 104, and/or beneath the substrate 102.

In embodiments, the dimensions and shapes of the components of the energy harvesting device 100 may vary from what is shown and described herein. For example, metallic and non-metallic SRRs 104 with varying shapes, sizes, and dimensions may be used in which particles are electrically small (e.g., small in comparison to the free space wavelength). In embodiments, the array of the SRRs 104 may include silver traces and electrically small cells. In embodiments the SRRs 104 may be loaded with capacitive or inductive elements for the purpose of miniaturization and further enhancement of the energy collection and thus overall efficiency. The transmission line 108 and the ground plane 116 may be made of metallic or non-metallic materials.

Figure 4A:
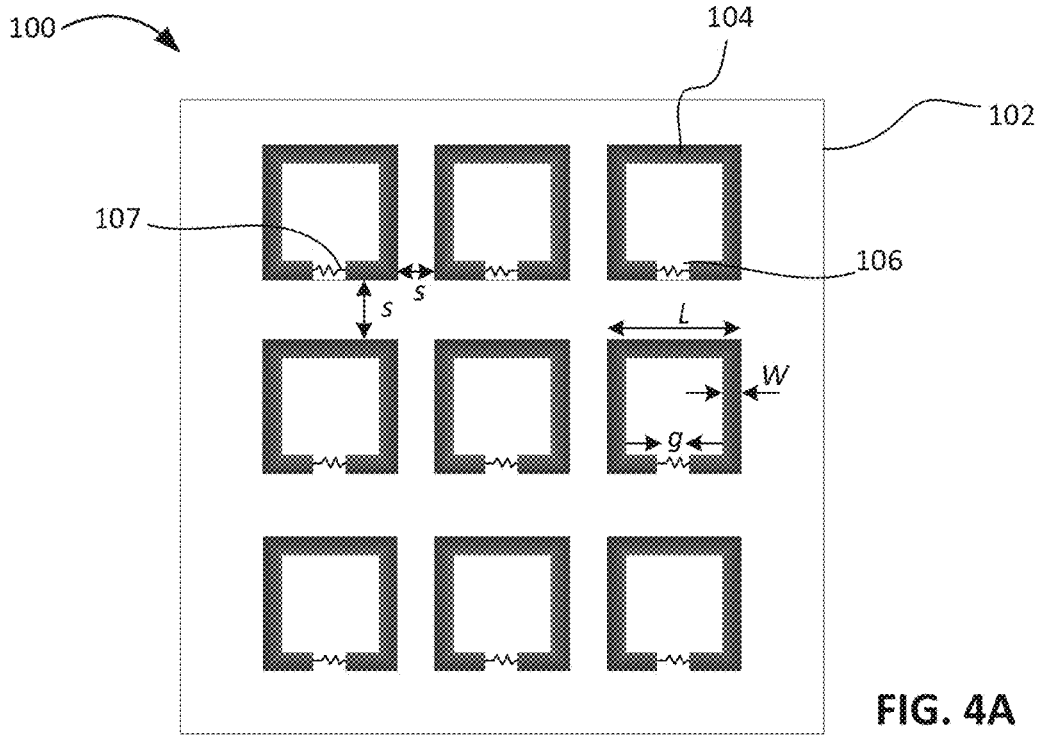
FIGS. 4A and 4B show plan views of various arrangements of SRRs in the energy harvesting device in accordance with aspects of the present invention.
Figure 4B:
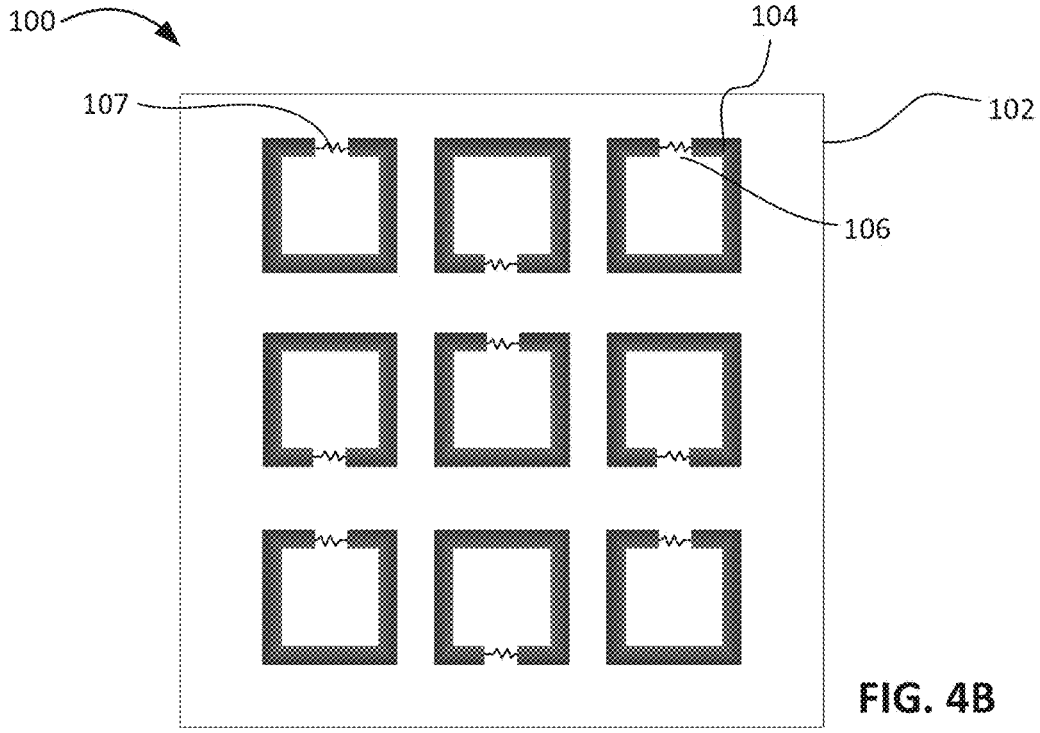

FIGS. 4A and 4B show plan views of various arrangements of SRRs in the energy harvesting device in accordance with aspects of the present invention. As shown in FIG. 4A, the SRRs 104 can be arranged as a 3×3 symmetrical array in which all of the SRRs 104 are oriented in the same way. In embodiments, dimensions for length L, width w, gap g, and space s may vary. As an illustrative non-limiting example, L may be approximately 40 um, w may be approximately 10 um, and g may be approximately 10 um. The thickness and dielectric constant of the substrate 102 may vary in embodiments. As an example, the thickness of the substrate 102 may be approximately 50 um and the dielectric constant may be approximately 11.9. The operating frequency of the energy harvesting device 100 may vary in embodiments. As an example, the operating frequency may be 400-480 GHz.

Referring to FIG. 4B, the SRRs 104 can be arranged as a 3×3 non-symmetrical array in which all of the SRRs 104 are oriented differently (e.g., the gaps are not aligned along the x-axis). As described herein, the power efficiency profile may vary based on different arrangements of the SRRs 104. Thus, the arrangement of SRRs 104 may be selected based on a desired power efficiency profile. Also, as should be understood by those of skill in the part, in embodiments, multiple arrays can be composed to form a grid panel by combining multiple transmission lines 108 to a single feeding point, by which a feasible amount of DC or AC power can be collected. Optimization of the array topology and the resistive load can be applied to maximize energy collection over a specific narrow or broad bandwidth.

In further embodiments, an ensemble of electrically small resonators (e.g., the SRRs 104) may operate at different frequencies. In embodiments, the electrically small resonators (e.g., the SRRs 104) may be scaled to operate in the infrared or visible frequency spectrum. In embodiments, a single or multiple energy harvesting devices 100 may be stacked in a planar fashion or vertically to collect power from intentional or unintentional radiators to charge nearby or remotely located batteries.

FIGS. 5A-5D show a process for manufacturing the energy harvesting device in accordance with aspects of the present invention. SRRs 104, a waveguide structure (e.g., the transmission line 108), and/or the ground plane 116 may be formed by a lithographic process, a self-assembly process or by a printed circuit board process.

Figure 5A:
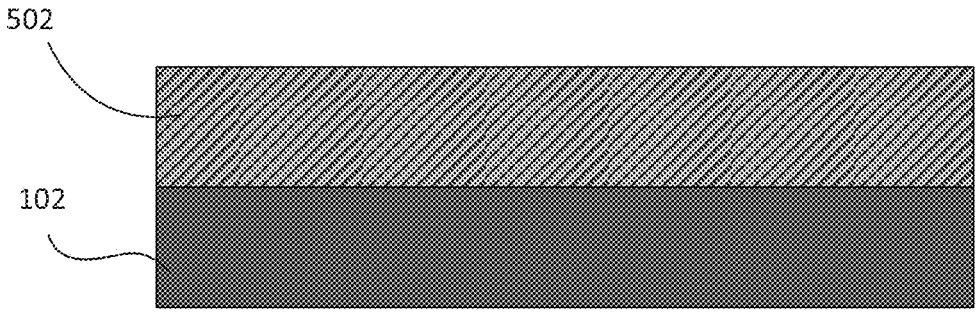
FIGS. 5A-5D show a process for manufacturing the energy harvesting device in accordance with aspects of the present invention.

As described herein, the energy harvesting device 100 may be fabricated on an intrinsic double-side polished silicon wafer (e.g., the substrate 102), with a high resistivity and low losses at an operating frequency (e.g., <100> oriented, undoped, ρ>10,000 Ω·cm, 180 μm thick), to minimize potential measurement errors. As shown in FIG. 5A, the substrate 102 is coated with Polymethylmethacrylate (PMMA) resist 502, which is a positive electron-beam resist, on top of the substrate 102 (e.g., at 3200 rotations per minute (RPM)) giving a relatively thick PMMA film (e.g., approximately 600 nm). The structure with the substrate 102 and the PMMA resist 502 is baked (e.g., at 180° C.) on a hotplate.

Figure 5B:
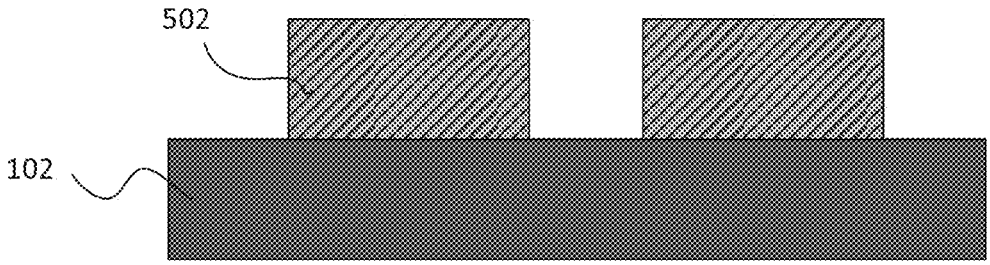

Referring to FIG. 5B, the PMMA resist 502 is exposed to a lithography process (e.g., electron-beam lithography (EBL)). In an example embodiment, the PMMA resist 502 is exposed to EBL at 20 keV with area dose of 200 μC/cm2, using any suitable EBL system. The exposed PMMA resist 502 may be developed using a suitable solvent (e.g., MIBK: IPA 1:3 solvent) and rinsed in 2-propanol (IPA). Use of IPA, which has lower surface energy than water, may result in a reduced level of peel off. The resulting structure is dried (e.g., by a Nitrogen spray gun). This forms the pattern shown in FIG. 5B.

Figure 5C:
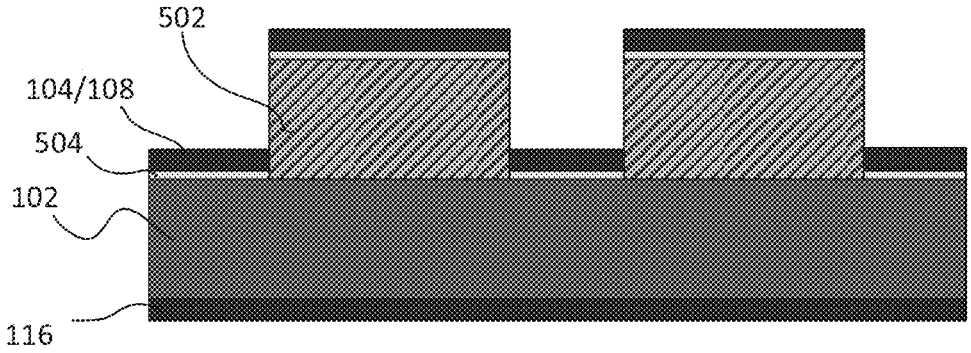

Referring to FIG. 5C, a thin film (e.g., approximately 5 nm) of titanium 504 or other appropriate conductive material may be deposited on the PMMA resists 502 and on the exposed surface of the substrate 102. A top silver layer is then deposited on the titanium 504, forming the SRR 104 and the transmission line 108. For example, the titanium 504 may be used (e.g., since silver metal may not be a suitable material for direct contact with the silicon material of the substrate 104, since silver does not adhere well with silicon). The titanium 504 may be deposited with a relatively slow evaporation rate (e.g., 0.5° A/sec) and without breaking the vacuum in order to enhance the silver adhesion. As an example, the silver thickness can be decreased (e.g., to 195 nm) to maintain a total metallic thickness of e.g., 200 nm. The silver e.g., with a thickness of approximately 200 nm can be deposited onto the resist pattern (e.g., by electron-beam evaporation at an evaporation rate of 1.5° A/sec).

Figure 5D:
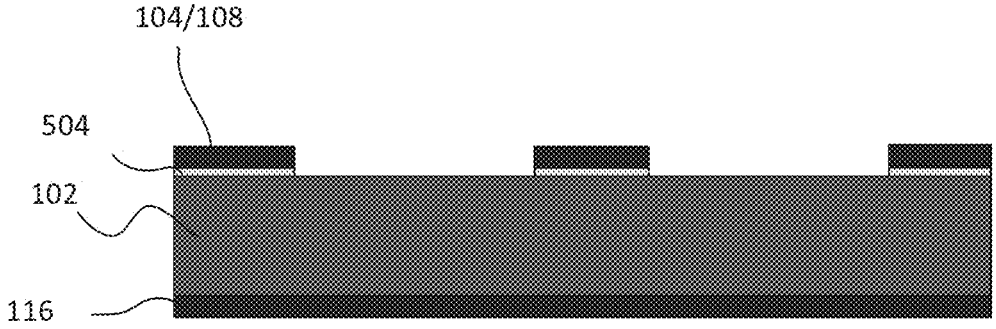

Referring to FIG. 5D, the PMMA resist 502 is lifted off, e.g., using a suitable remover. The PMMA resist 502 may be dissolved in a heated beaker, e.g., at 90° C., whereby, the metal layer on top of the PMMA resist 502 is lifted off. This leaves the transmission line 108 and the SRR 104 formed on the substrate 102.

Figures 6A, 6B:
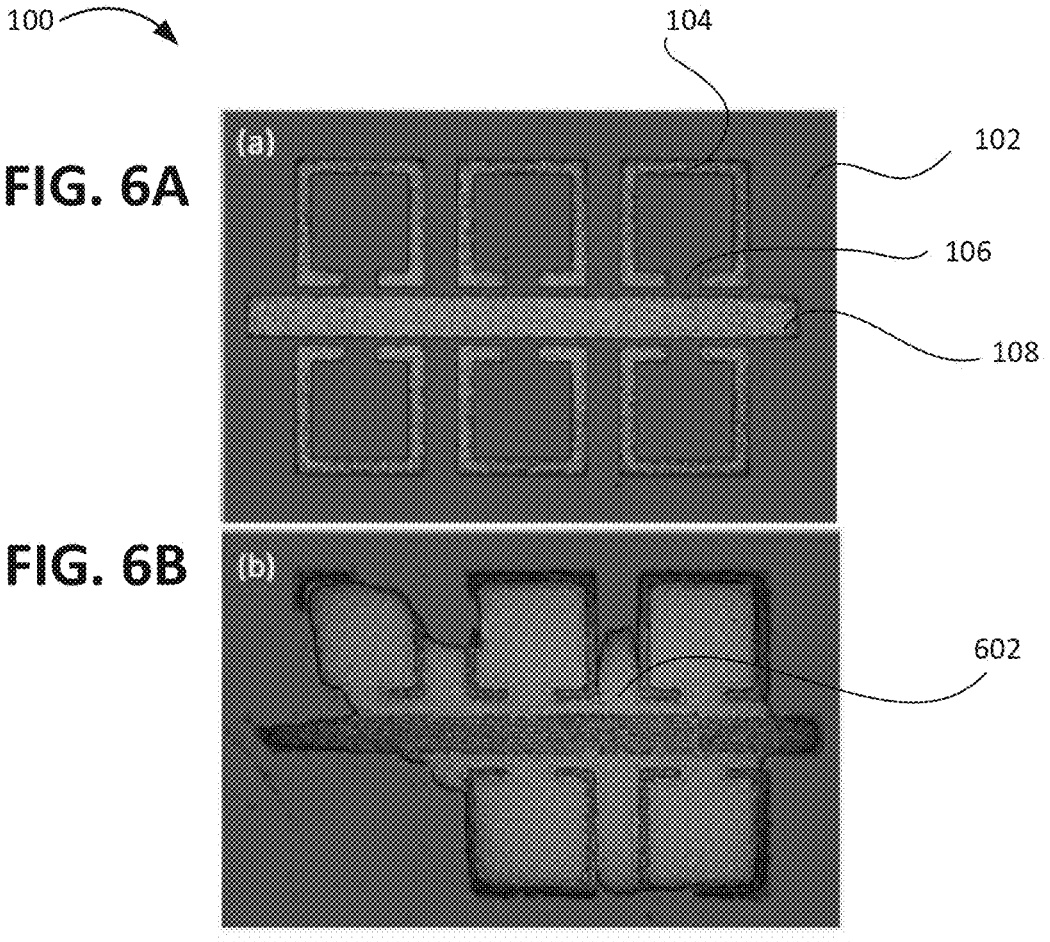
FIG. 6A shows the energy harvesting device when fabricated with a titanium layer in accordance with aspects of the present invention.
FIG. 6B illustrates the energy harvesting device when fabricated without a titanium layer in accordance with aspects of the present invention.

FIG. 6A shows the energy harvesting device 100 when fabricated with a titanium layer in accordance with aspects of the present invention. FIG. 6B illustrates the energy harvesting device 100 when fabricated without a titanium layer. As shown in FIG. 6A, the components of the energy harvesting device 100 are adhesively attached to the substrate 102 in a clean and secure manner. Conversely, as shown in FIG. 6B, relatively poor adhesion is observed when the energy harvesting device 100 is fabricated without a titanium layer. For example, the poor adhesion is shown by an overflow of the adhesive material 602.

Figure 7:
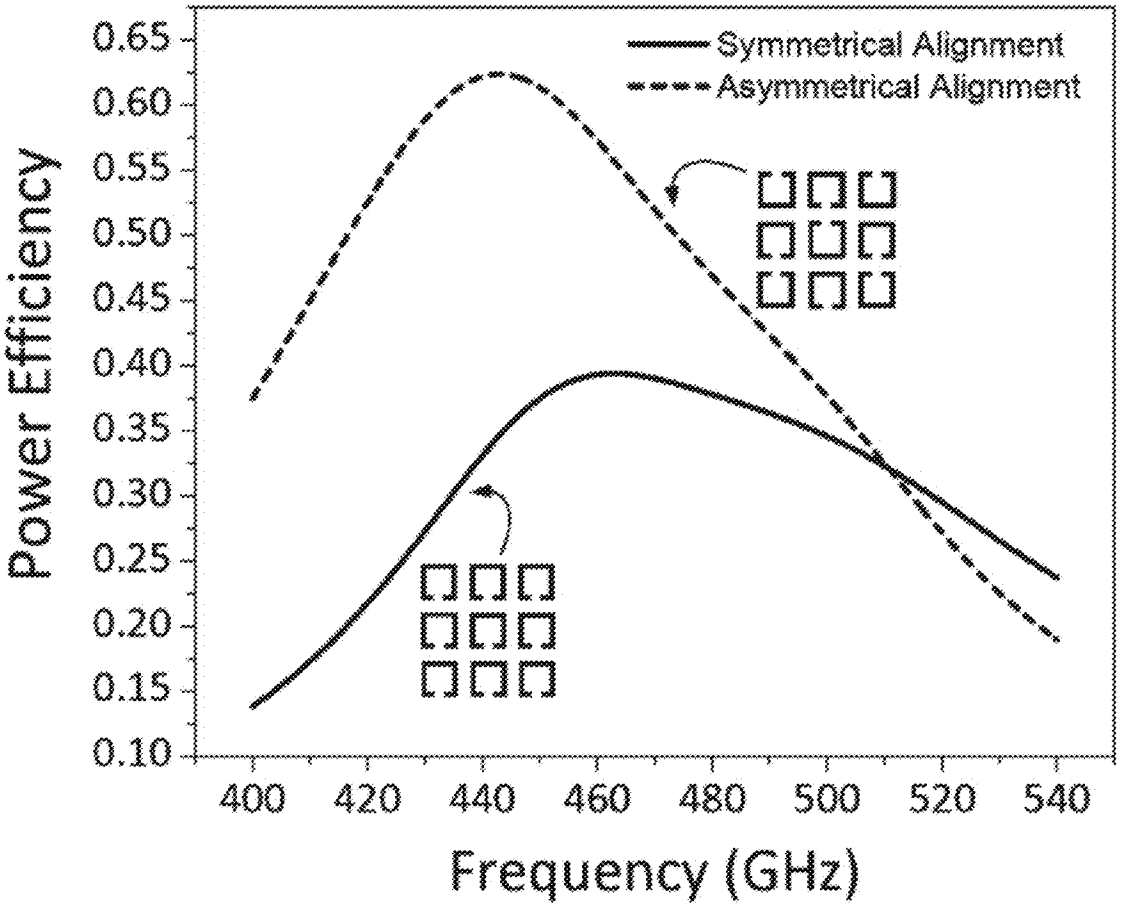
FIG. 7 shows a graph that shows harvest power efficiency profiles achieved by symmetric and asymmetric arrays in accordance with aspects of the present invention.

FIG. 7 is a graph that shows harvest power efficiency profiles achieved by symmetric and asymmetric arrays in accordance with aspects of the present invention. As shown in FIG. 7, an asymmetrical array (e.g., in which SRRs 104 are arranged in FIG. 4B) may achieve high power efficiencies than a symmetrical array for operating frequencies between approximately 400 GHz and approximately 510 GHz. The symmetrical array may achieve higher power efficiencies for operating frequencies from approximately 510 GHz onwards.

Figure 8:
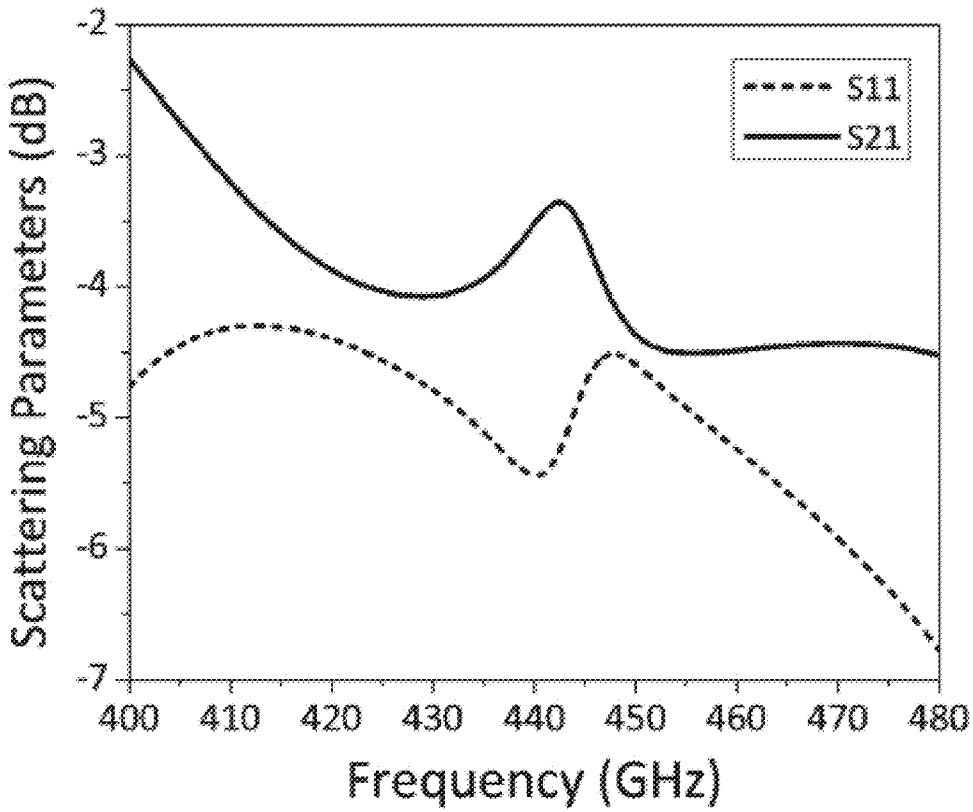
FIG. 8 shows a graph representing scattering parameters of the energy harvesting device before the placement of a resistive sheet in accordance with aspects of the present invention.
Figure 9:
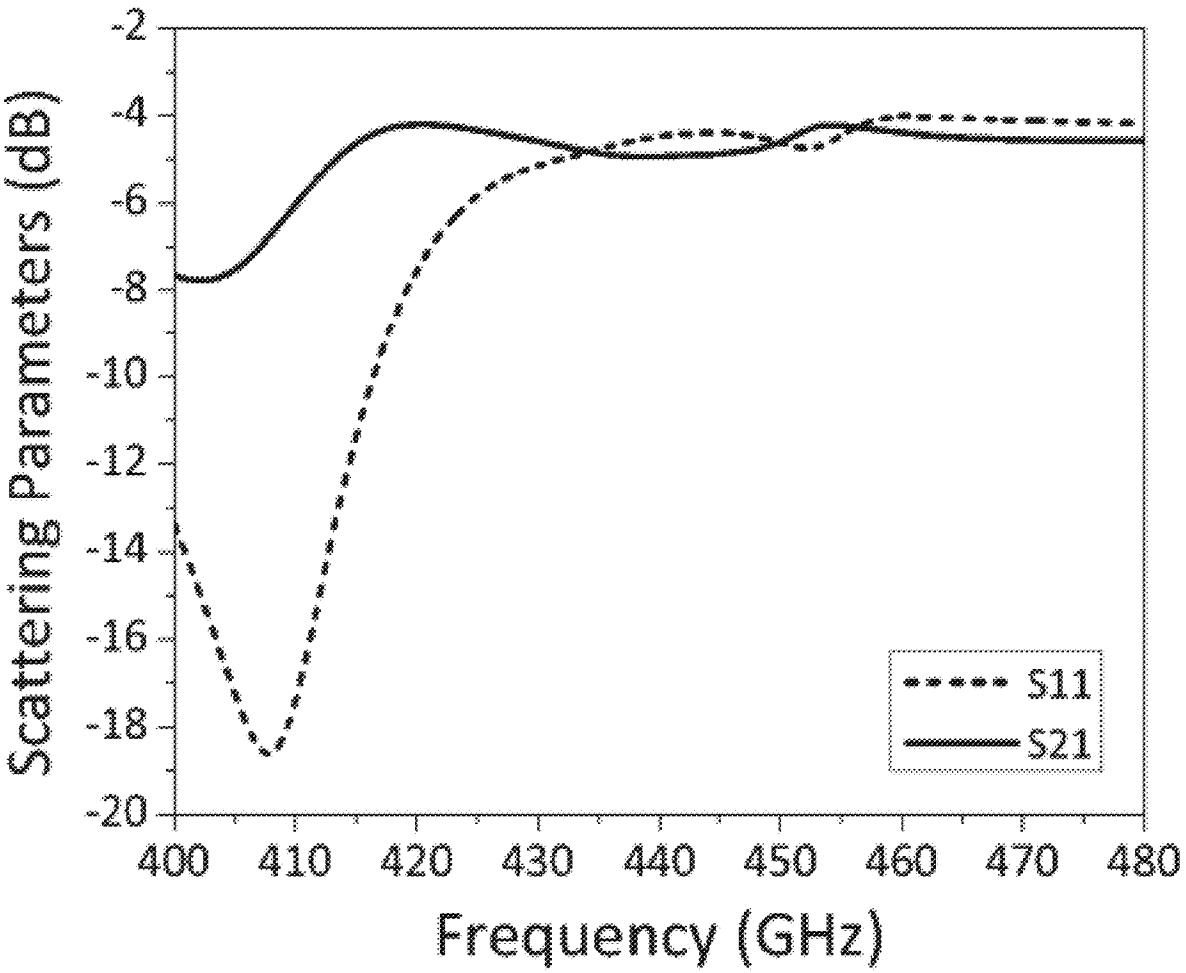
FIG. 9 shows a graph representing scattering parameters of the energy harvesting device after the placement of a resistive sheet in accordance with aspects of the present invention.

FIG. 8 shows a graph representing scattering parameters of the energy harvesting device before the placement of a resistive sheet in accordance with aspects of the present invention. FIG. 9 shows a graph representing scattering parameters of the energy harvesting device after the placement of a resistive sheet in accordance with aspects of the present invention. The scattering parameters are determined by testing the energy harvesting device 100 using radiation boundary conditions excited with an incident wave.

FIGS. 8 and 9 respectively show the reflection coefficient as S11 and the transmission coefficient as S12. FIGS. 8 and 9 show that 30% of the incident power is reflected. The power passing through the energy harvesting device 100 accounts for more than 50% of the transmitted waves at approximately 408 gigahertz (GHz). These numerical experiments indicate that the energy harvesting device 100 can act as a power absorber or a collector. After loading the array with a resistance (e.g., a 100Ω resistance) connected at one terminal of the transmission line (e.g., the transmission line 108), and by substituting the scattering parameters from FIG. 9 in equation (1) below and at frequency 408 GHz., leads to S11=0.116 and S21=0.462 with δ=0.227.

$$|S21|^2+|S22|^2=\delta \quad (1)$$

Figure 10:
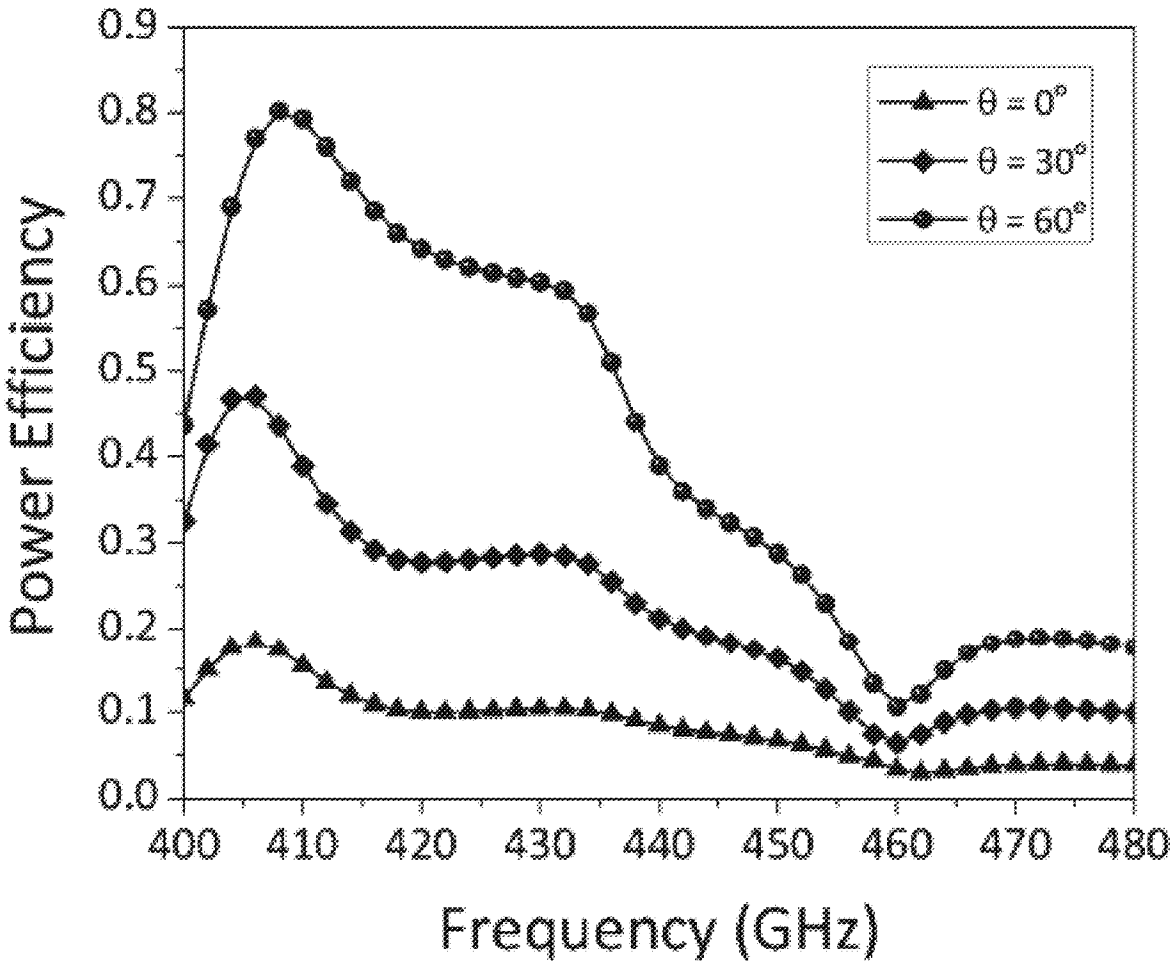
FIG. 10 shows a graph representing power efficiency profiles of the energy harvesting device when exposed to incident waves at various angles in accordance with aspects of the represent invention.

FIG. 10 shows a graph representing power efficiency profiles of the energy harvesting device when exposed to incident waves at various angles in accordance with aspects of the represent invention. As shown in FIG. 10, the highest power efficiency of approximately 80% occurs when the operating frequency is close to 410 GHz at an incidence angle θ=60°. Approximately 45% and 20% harvesting efficiencies are achieved at the resonance frequency with incidence angles of θ=30° and θ=0°, respectively.

Figure 11:
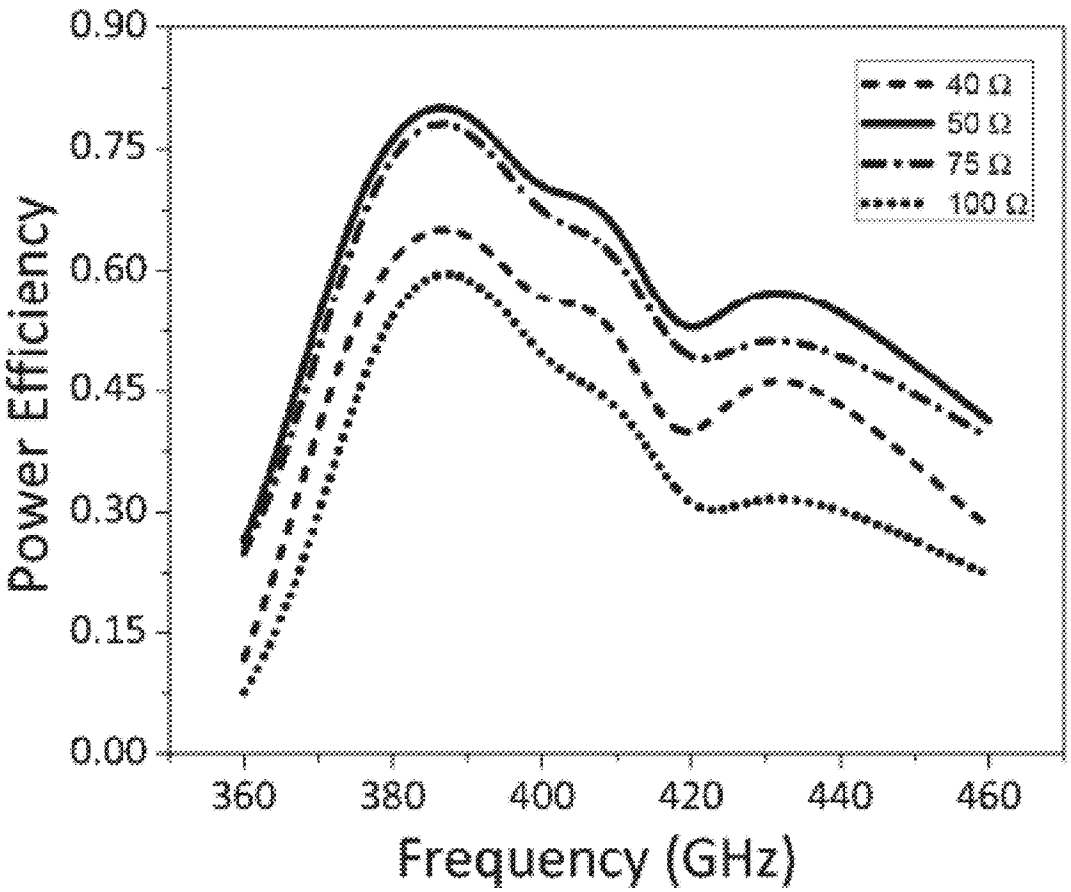
FIG. 11 shows a graph representing power efficiency profiles of the energy harvesting device after adding a titanium layer and loading by different resistive sheets in accordance with aspects of the present invention.

FIG. 11 shows a graph representing power efficiency profiles of the energy harvesting device after adding a titanium layer and loading by different resistive sheets in accordance with aspects of the present invention. As shown in FIG. 11, an approximately 80% harvesting efficiency is achieved at a normal incidence angle and with optimal load of 50Ω.

Terra Hertz (THz) time-domain spectroscopy (THz-TDS) testing techniques can be conducted on the energy harvesting device 100 to further measure the performance of the energy harvesting device. Transmission mode THz-TDS can be desirable over other measurement techniques due to its high reliability and availability of facility issues. Appropriate modifications can be made to the energy harvesting device 100 to be compatible with THz-TDS experiment setup in the transmission mode. For example, the energy harvesting device 100 may be fabricated without the ground plane 116 and/or the resistive sheet 114, and only the top metallic structure with the silicon substrate may be considered. In addition, to allow enough THz beam interaction with the energy harvesting device 100, an adequate patch size of the sample is necessary to ensure accurate measured results. Accordingly, the energy harvesting device 100, for the purposes of testing using the THz-TDS experiment setup, may include an array composed of, for example, 3000 SRRs 104 resulting in an approximately 7 mm×7 mm sample size. Any conventional transmission mode THz-TDS experiment setup can be used (e.g., a setup that includes the use of femtosecond lasers, transmitters, receivers, photoconductive antennas, off-axis mirrors, and/or computing hardware and software).

Figure 12A:
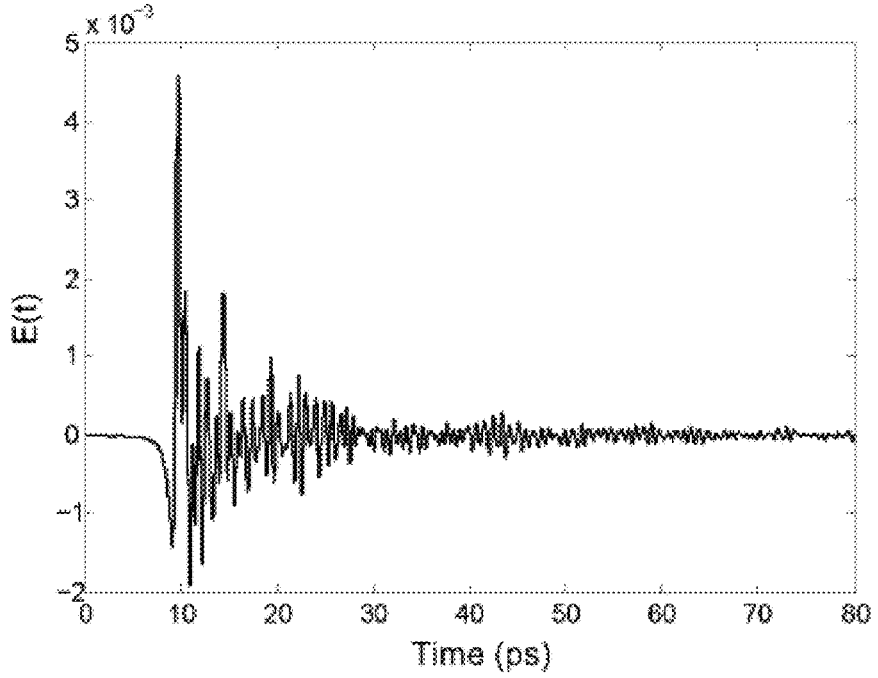
FIG. 12A shows a graph representing a temporal THz wave of the energy harvesting device in accordance with aspects of the present invention.

FIG. 12A shows a graph representing a temporal THz wave of the energy harvesting device in accordance with aspects of the present invention. More specifically, FIG. 12A shows measured THz temporal pulses, in transient mode, of THz beams tested through the energy harvesting device 100 using the THz-TDS experiment setup as described herein. Further, the reference (pure silicon) were Fourier transformed to THz spectrums.

Figure 12B:
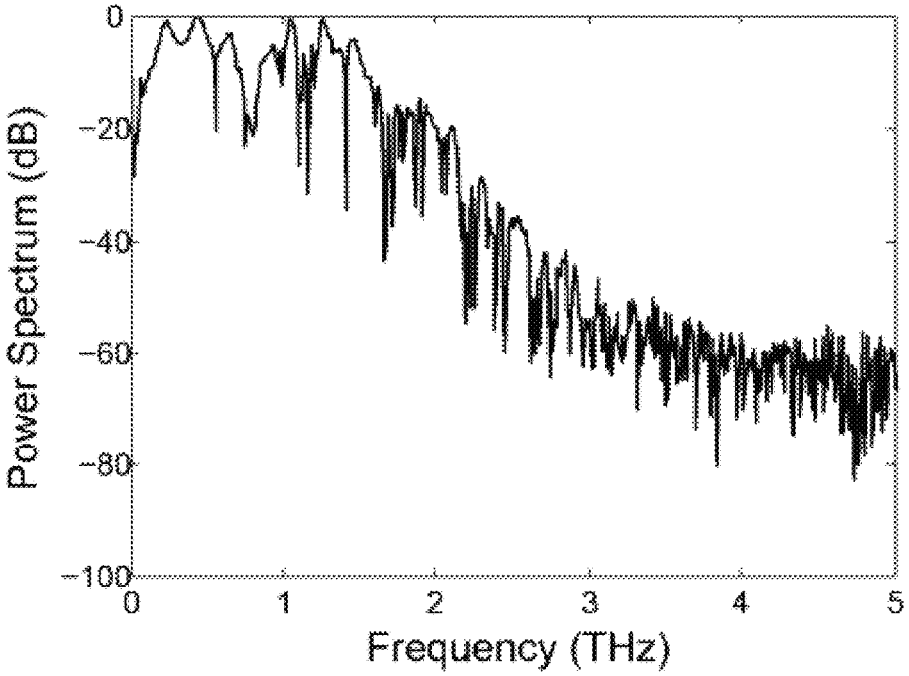
FIG. 12B shows a graph representing a power spectrum profile of the THz wave of the energy harvesting device in accordance with aspects of the present invention.

FIG. 12B shows a graph representing a power spectrum profile of the THz wave of the energy harvesting device in accordance with aspects of the present invention. As shown in FIG. 12B, the oat zone silicon used in the structure behaves linearly in THz-TDS. From the data in the graph of FIG. 12B, transmission information can be obtained from the ratio between the sample and reference spectrums.

Figure 13:
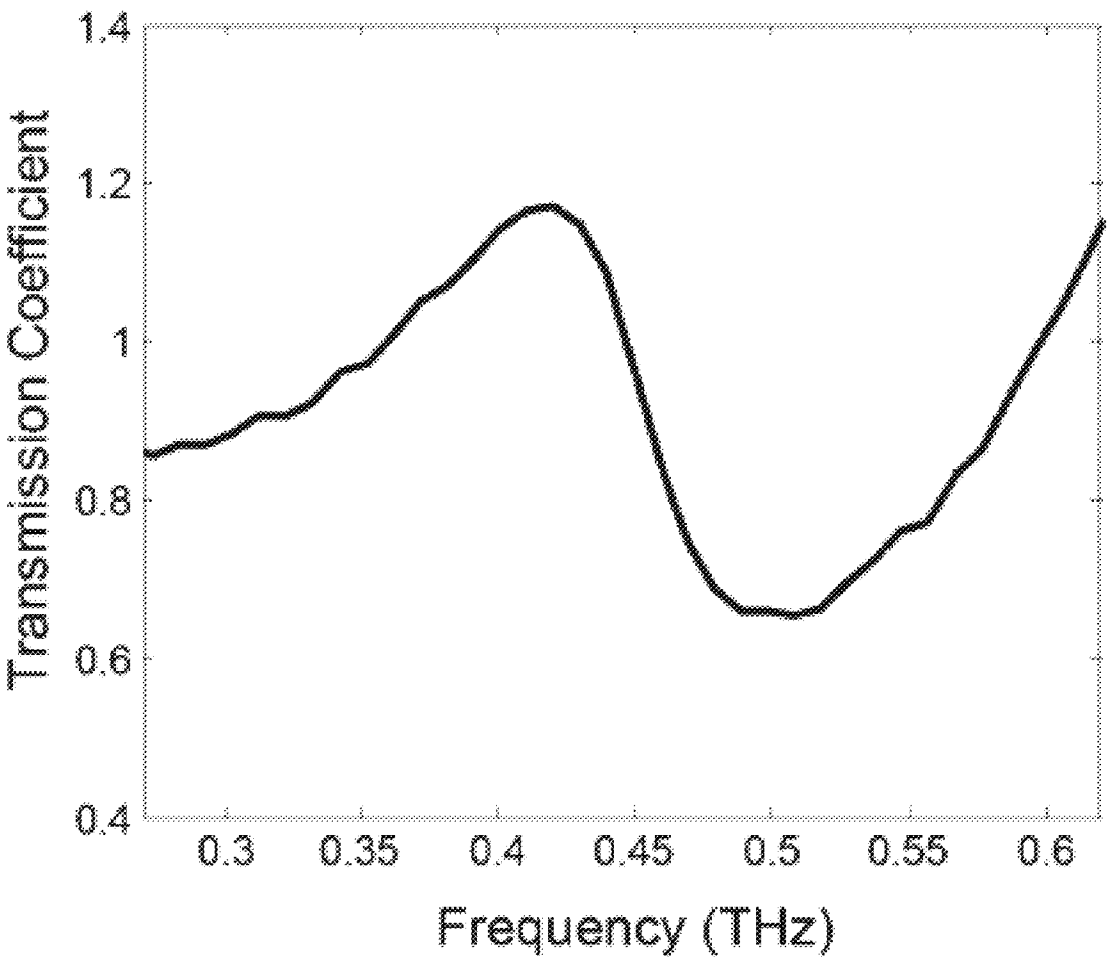
FIG. 13 shows a graph illustrating the transmission magnitude of the energy harvesting device in accordance with aspects of the present invention.

FIG. 13 shows a graph illustrating the transmission magnitude of the energy harvesting device in accordance with aspects of the present invention. As shown in FIG. 13, the energy harvesting device 100 shows a resonance behavior approximately at 0.41 THz which is a relatively close match with the resonance frequency shown in FIG. 11.

Figure 14:
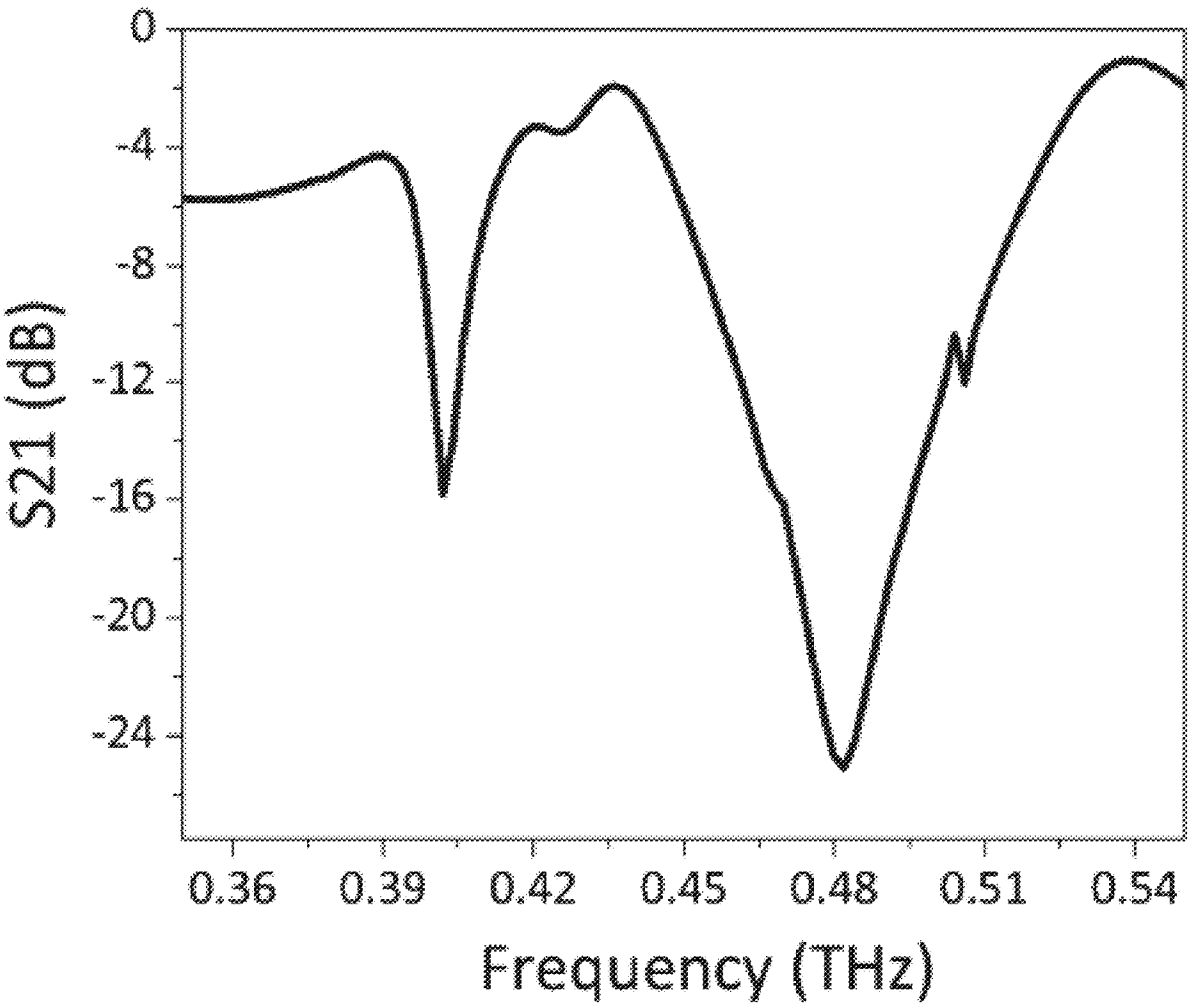
FIG. 14 shows a graph illustrating the calculated transmission coefficient of a modified energy harvesting device in accordance with aspects of the present invention.

In embodiments, the energy harvesting device 100 may have a modified ground plane 116 forcing the energy harvesting device 100 periodicity, so that both the simulated and fabricated structures yield similar results. FIG. 14 shows a graph illustrating the calculated transmission coefficient of a modified energy harvesting device in accordance with aspects of the present invention. A similar transmission same profile is obtained using the modified energy harvesting device 100 (e.g., a periodic structure with the obviation of the ground plane 116). Deviation in transmission coefficients between the two embodiments are may be due to the different setups and test environments of both the THz-TDS and simulation experiments Aspects of the present invention include a transmission line 108 to channel the energy harnessed from the SRRs 104 (e.g., to an external system). While the aspects of the present invention include a transmission line 108 other optimum energy harvesting results can be achieved using other waveguiding structures and techniques. For example, other waveguiding structures may be used if the transmission line 108 is excited and high edge currents on the transmission line 108 exist, giving rise to enhanced magnetic field within the SRRs 104. In embodiments, the electromagnetic energy collecting of the energy harvesting device 100 may operate in the microwave, millimeter, terahertz, infrared and/or visible frequency regimes.

In embodiments, the energy harvesting device 100 can be fabricated using conventional fabrication processes. For example, the energy harvesting device 100 of the present invention can be manufactured in a number of ways using a number of different tools. In general, though, the methodologies and tools are used to form structures with dimensions in the micrometer and nanometer scale. The methodologies, i.e., technologies, employed to manufacture the energy harvesting device 100 of the present invention have been adopted from integrated circuit (IC) and printed circuit board technology. For example, the structures of the present invention are realized in films of material patterned by photolithographic processes. In particular, the fabrication of the organic probe substrate of the present invention uses three basic building blocks: (i) deposition of thin films of material on a substrate, (ii) applying a patterned mask on top of the films by photolithographic imaging, and (iii) etching the films selectively to the mask. As described herein, harnessing energy from clean and sustainable resources is of crucial importance. Several attempts through different technologies have been pursued to achieve efficient and sustainable energy production systems. However, having systems with a high energy harvesting efficiency and at the same time low energy production cost are challenging with the existing technologies. Aspects of the present invention provide an energy harvesting device 100 for electromagnetic field energy harvesting, ranging from microwave and to THz, infrared and visible light that employs electrically small particles such as SRRs (e.g., SRRs 104) and waveguiding structures (e.g., transmission line 108). Further, as described herein, the energy harvesting device 100 may include a ground plane 116 that achieves significantly enhanced energy harvesting or energy collection efficiency while occupying smaller footprint. Aspects of the present invention may be used for electromagnetic energy harvesting and/or to wirelessly transfer power.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed:

1. An energy harvesting device comprising:

a substrate;

a plurality of split-ring resonators (SRRs) on the substrate configured to generate a voltage based on receiving incident light waves;

a transmission line electrically coupled to the plurality of SRRs, the transmission line being configured to transmit the generated voltage to an external system;

a ground plane electrically coupled to the transmission line; and a resistive sheet electrically coupled to the ground plane.

2. An energy harvesting device comprising:

a substrate;

a plurality of split-ring resonators (SRRs) on the substrate configured to generate a voltage based on receiving incident light waves; and a transmission line electrically coupled to the plurality of SRRs, the transmission line being configured to transmit the generated voltage to an external system, wherein the plurality of SRRs are arranged symmetrically or asymmetrically.

3. The energy harvesting device of claim 2, wherein each of the plurality of SRRs includes a gap.

4. The energy harvesting device of claim 2, wherein the energy harvesting device is configured to operate in the microwave, millimeter, terahertz, infrared or visible frequency regimes.

5. The energy harvesting device of claim 2, wherein the plurality of SRRs are configured to operate at different frequencies.

6. An energy harvesting device comprising:

a substrate;

a plurality of split-ring resonators (SRRs) on the substrate configured to generate a voltage based on receiving incident light waves; and a transmission line electrically coupled to the plurality of SRRs, the transmission line being configured to transmit the generated voltage to an external system, wherein the energy harvesting device is configured to have different power efficiencies based on an angle of the incident light waves.

7. An energy harvesting device comprising:

a substrate;

a plurality of split-ring resonators (SRRs) on the substrate, wherein the plurality of SRRs are configured to generate a voltage based on receiving incident light waves;

a transmission line electromagnetically coupled to the plurality of SRRs, wherein the transmission line is configured to transmit the generated voltage to an external system;

a via located at a distal end of the transmission line;

a ground plane electrically coupled to the transmission line through the via; and a resistive sheet electrically coupled to the ground plane.

8. An energy harvesting device comprising:

a substrate;

a plurality of split-ring resonators (SRRs) on the substrate, wherein the plurality of SRRs are configured to generate a voltage based on receiving incident light waves;

a transmission line electromagnetically coupled to the plurality of SRRs, wherein the transmission line is configured to transmit the generated voltage to an external system;

a via located at a distal end of the transmission line; and a ground plane electrically coupled to the transmission line through the via, wherein the plurality of SRRs are arranged symmetrically or asymmetrically.

9. The energy harvesting device of claim 8, wherein each of the plurality of SRRs includes a gap.

10. The energy harvesting device of claim 8, wherein the energy harvesting device is configured to operate in the microwave, millimeter, terahertz, infrared or visible frequency regimes.

11. The energy harvesting device of claim 8, wherein the plurality of SRRs are configured to operate at different frequencies.

12. The energy harvesting device of claim 8, wherein the plurality of SRRs are configured to operate in an infrared or a visible frequency spectrum.

13. An energy harvesting device comprising:

a substrate;

a plurality of split-ring resonators (SRRs) on the substrate, wherein the plurality of SRRs are configured to generate a voltage based on receiving incident light waves;

a transmission line electromagnetically coupled to the plurality of SRRs, wherein the transmission line is configured to transmit the generated voltage to an external system;

a via located at a distal end of the transmission line; and a ground plane electrically coupled to the transmission line through the via, wherein the energy harvesting device is configured to have different power efficiencies based on an angle of the incident light waves.

14. An energy harvesting device comprising:

a substrate;

a plurality of electrical resonators on the substrate, wherein the plurality of electrical resonators are configured to generate a voltage based on receiving incident light waves; and a waveguide electrically coupled to the plurality of electrical resonators, wherein the waveguide is configured to transmit the generated voltage to an external system, wherein the plurality of electrical resonators include at least one of:

a split-ring resonator (SRR); and a resonator that is substantially smaller in comparison to a free space wavelength.

15. An energy harvesting device comprising:

a substrate;

a plurality of electrical resonators on the substrate, wherein the plurality of electrical resonators are configured to generate a voltage based on receiving incident light waves; and a waveguide electrically coupled to the plurality of electrical resonators, wherein the waveguide is configured to transmit the generated voltage to an external system, wherein the waveguide is a metallic transmission line.

* * * * *